US005431785A

United States Patent [19]

Bubik et al.

[11] Patent Number: 5,431,785

[45] Date of Patent: Jul. 11, 1995

[54] MULTILAYER HEAD BOX FOR A PAPER MACHINE

[75] Inventors: Alfred Bubik, Ravensburg; Klaus Lehleiter, Wilhelmsdorf-Zussdorf, both of Germany

[73] Assignee: Sulzer-Escher Wyss GmbH, Ravensburg, Germany

[21] Appl. No.: 96,155

[22] Filed: Jul. 22, 1993

[30] Foreign Application Priority Data

Jul. 31, 1992 [DE] Germany ..... 42 25 297.0

[51] Int. Cl.[6] ..... D21F 1/02

[52] U.S. Cl. ..... 162/343; 162/344; 162/347

[58] Field of Search ..... 162/336, 343, 344, 347, 162/212, 123, 125

[56] References Cited

U.S. PATENT DOCUMENTS

| | | | |
|---|---|---|---|
| 3,802,966 | 4/1974 | Delekto et al. | 162/343 |
| 4,141,788 | 2/1979 | Justus | 162/343 |
| 4,181,568 | 1/1980 | Pfaler | 162/343 |
| 4,381,219 | 4/1983 | Bubik et al. | 162/343 |
| 4,526,653 | 7/1985 | Andersson | 162/343 |
| 4,543,162 | 9/1985 | Hildebrand | 162/343 |
| 4,824,524 | 4/1989 | Hildebrand | 162/343 |
| 5,129,988 | 7/1992 | Farrington, Jr. | 162/123 |

FOREIGN PATENT DOCUMENTS

| | | |
|---|---|---|
| 374843 | 6/1984 | Austria . |
| 3107926A1 | 11/1982 | Germany . |
| 3126460C2 | 12/1982 | Germany . |
| 4029545 | 3/1992 | Germany . |
| 2093879 | 9/1982 | United Kingdom . |
| 2094364 | 9/1982 | United Kingdom . |

*Primary Examiner*—Karen M. Hastings
*Attorney, Agent, or Firm*—Townsend & Townsend Khourie & Crew

[57] ABSTRACT

The proposed multilayer head box for a paper machine or similar is constructed so that it can produce a wide jet consisting of at least three individual jets (5, 5', 5'') The individual jets are fed through separate channels (3, 3'', 3'') and emitted out of the head box and subsequently combine to form a single wide jet. The individual channels are so constructed that further outer lying jets can be diverted sufficiently after having been emitted out of their respective channel, so that they meet the respective further inner lying partial stream at a very slight angle. The problem of separation when the partial streams are diverted as well as that of undesired lateral mixing when the partial streams are combined are thereby prevented.

14 Claims, 2 Drawing Sheets

MULTILAYER HEAD BOX FOR A PAPER MACHINE

TECHNICAL BACKGROUND

As is known, head boxes are used to form a web consisting of at least three layers on a paper machine or similar. It is usually meaningful to manufacture the various layers with different properties. Such properties are for example the type or nature of the fiber or also other parameters such as consistency, fine particle content or similar. The head box used for this, has, among other things, the task of producing a wide jet which then subsequently enters for instance into the forming region of a paper machine. For this, it is expedient to provide a pressure channel, also called a nozzle volume, in the head box which opens out into a slit for each of the suspension streams. Pressure energy is converted into movement energy during the flow of material suspension through the channel/nozzle and on emission from the slit, i.e. the suspension is accelerated considerably.

In the known trilayer and multilayer head boxes, the individual partial streams in the jet converge at a particular angle. This angle is largely dependent on the construction parameters of the head box, for instance the spatial requirement of material supply and material distribution and of the positioning devices. On convergence of the various suspension partial streams in the jet, the further outer lying partial streams also have, as a result of the angle, a speed component at right angles to the direction of a neighbouring partial stream. As a result of these speed components, flow momentum exists in this transverse direction which amplifies the intermixing of neighbouring layers. The degree to which this mixing occurs is undesired. After all, such a multilayer head box is considerably more expensive than a single layer head box not only in its manufacture but also in operation and the benefit of this expense is reduced if an adequate separation of the various partial streams in the sheet is not possible.

A guiding which is, as far as possible, parallel—i.e. at an acute angle—of the partial streams in the head box is conceivable and sometimes practised. The undesired lateral speed components can thereby be kept small but on the other hand the head box becomes even larger hence longer and still more expensive.

In other known head boxes with a short construction the partial streams are already diverted in the head box so that they can be emitted almost parallel. This can lead to separation and secondary streams forming in the pressure channels of the outer layers where the diversion takes place which are detrimental to the jet uniformity.

PRINCIPAL OBJECT OF THE INVENTION

The object of the present invention is therefore to combine a convergence of the partial streams which is as parallel as possible and thereby a reduction of transverse speeds which may occur with a compact construction of the head box thereby avoiding separation and jet disturbances as far as is possible.

BRIEF DESCRIPTION OF THE INVENTION

In the use of the head box in accordance with the invention, the material suspension fed in the channel will expediently be different in type and composition. In particular, one often endeavours in paper production to employ different fiber qualities in different layers of the paper produced.

The effectiveness of the subject of the invention in the satisfaction of the object can be still further improved when the flow speed of neighbouring partial streams is different.

BRIEF DESCRIPTION OF THE DRAWINGS

The invention and its advantages will now be described in more detail with the aid of the drawings which schematically show.

DESCRIPTION OF PREFERRED EMBODIMENTS

Figure 1:
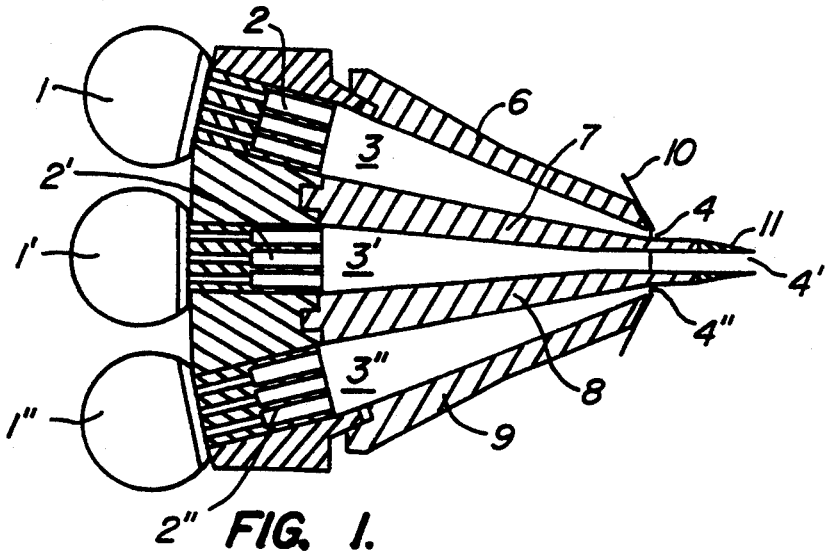
FIG. 1 a trilayer head box in accordance with the invention sectioned in side view.
Figure 2:
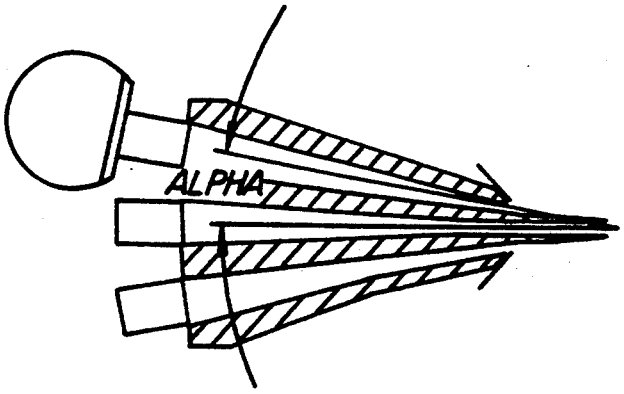
FIG. 2 heavily simplified, a variant of the subject shown in FIG. 1.

The representation in FIG. 1 shows a sectioned side view of a trilayer head box constructed in accordance with the invention. In this, the three suspension streams are supplied with the suspension over substantially the whole width by the transverse flow distributors 1, 1', 1'' Subsequently, suspension reaches the turbulence producers 2, 2', 2'' which are provided here with graded ducts The turbulence producers are joined to respective channels 3, 3', 3'' each of which is filled with pressurized material suspension during operation. The channels are bordered by rigid outer bordering walls 6, 9 and inner bordering walls 7, 8. It can be clearly seen, that the channels extend substantially straight. The central surface between the bordering walls forming a channel, for instance 6 and 7, change their direction within the channel either not at all or only very little, at the most by 3° to 5°. This means that, in the channel, no appreciable diversion of the suspension streams fed in during operation takes place. Its direction is changed first after the emission of the further outer lying stream so that it can substantially adjust itself to the further inner lying stream. The inner bordering walls 7, 8 are rigid in the initial position, but become deformable over a substantial part of their length. Thus, the inner and outer channels have substantially the same pressure. Ambient pressure prevails during this process. Therefore the free surface of the flowing suspension can adjust itself completely unhindered. A separation from the walls with the damaging consequences for the jet can therefore be prevented in this way. As can be seen in FIGS. 1 and 2, a substantially straight course corresponding to each channel begins at each distributor.

The exit slits 4, 4'' of the outer lying channels 3, 3'' can be adjusted by screens 10. At the end of separating walls 7 and 8 lying between two channels are guiding surfaces which converge at an acute angle. The surface of the separating walls 7, 8 facing toward the outer walls 6, 9 preferably has an angular change of at least 5 degrees in the direction towards outer walls 6, 9. It is often helpful although not absolutely-necessary to construct them as flexible separating lamellae 11. Lamellae of this kind can partly reduce the undesired mixing of neighbouring layers.

The parts of the paper machine or similar which receive and dewater the previously formed multilayer jet and then form the web are not shown.

In the even simpler representation of FIG. 2, the relative angle alpha between neighbouring channels 3, 3′, 3″ is chosen to be even more acute at 10°. It should be noted, however, that angle alpha can range from 8–45 degrees and will preferably be between 10–20 degrees. These measures, which are beneficial for the operation of the head box, are not easy to implement, principally due to problems of space.

Figure 3:
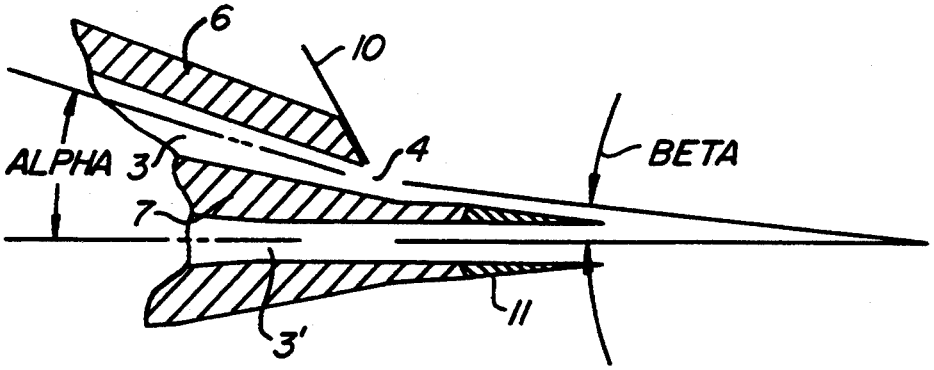
FIG. 3 partial section of the subject shown in FIG. 1.

FIG. 3, which is also very schematic, shows the angle beta at which two neighbouring partial streams emitted out of the channels 3 and 3′ converge. Preferably, angle beta is less than or equal to 10 degrees and typically will range between 1–5 degrees.

Figure 4:
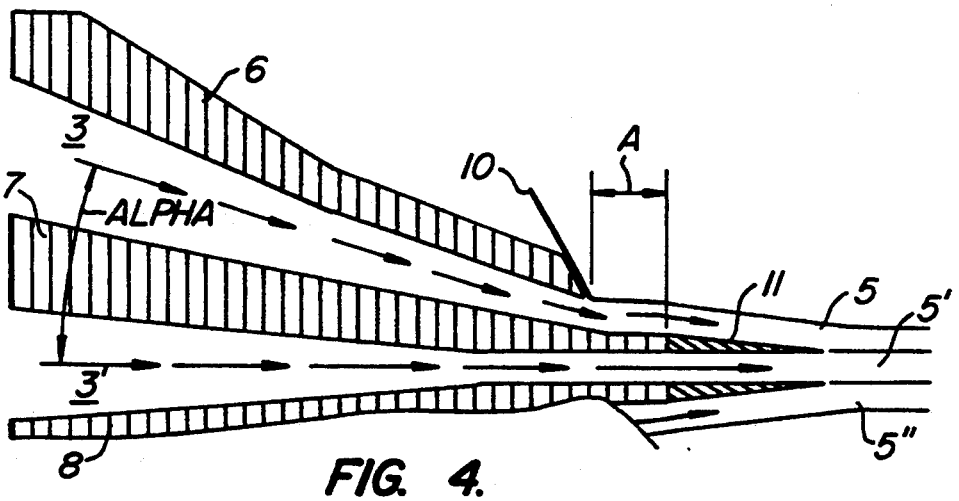
FIG. 4 and 5 each a partial section of the subject of the invention sectioned in side view.
Figure 5:
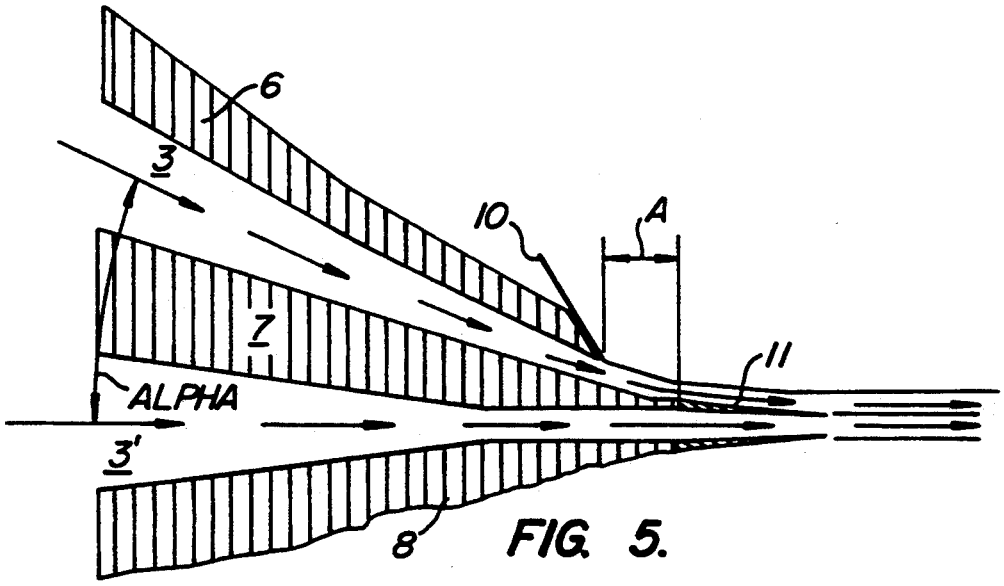

The flow relationships can be seen in somewhat more detail in FIG. 4 and 5. A central surface can be defined for each channel as the locus of all points which are equidistant from the two bordering walls forming this channel. As viewed in the flow direction, the course of this surface shows, to an approximation, the central, flow direction. This is shown here by sequences of arrows. The angle alpha is the relative angle between neighbouring central flow directions, here the middle one and the one adjacently outside it. The flow direction within a channel is taken here as the average between the bordering walls.

Figure 6:
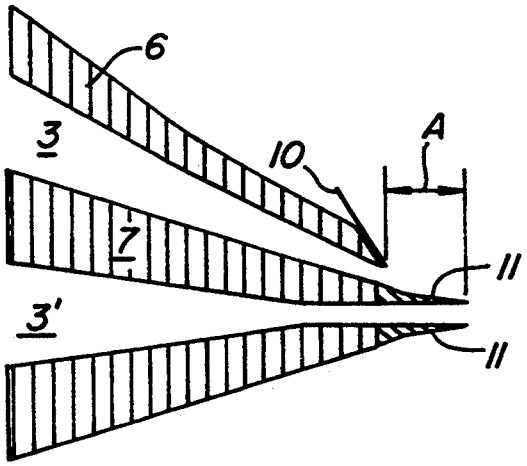
FIG. 6 a further embodiment sectioned in side view.

Furthermore, the distance A is shown formed between the end of the further outer lying bordering wall from the end of the further inner lying bordering wall. Preferably, distance A will be greater than 5 mm and typically will range from 10–60 mm. The flexible separating lamellae are neglected here when the directional change as described is intended to take place preferably at a fixed contour which, in this case, is present at the inner lying bordering wall 7. However, under certain conditions the effect used by the invention can also be realized in the region of the separating lamellae 11 in which case this is included in the determination of the value A (see FIG. 6).

FIG. 5 differs from FIG. 4 substantially in the fact that in FIG. 5 the angle alpha of about 23° is steeper than that of 15° shown in FIG. 3. The entire head box can thereby be made even more compact i.e. shorter in the flow direction.

It can be directly appreciated that the head box of the invention does not necessarily have to be arranged horizontally, rather it is possible to arrange it in such a way that it can produce an inclined, vertically upwardly or also vertically downwardly directed suspension jet. The advantages are also thereby achievable.

What is claimed is:

1. A headbox for a paper machine comprising:

at least one inner channel and at least two outer channels, the channels each having an outlet and an inlet and extending substantially over a width of the paper machine, the channels each having a center line with a substantially straight course that changes by no greater than 5 degrees from the inlet to the outlet, the outer channels each being oriented at an angle between 8 and 45 degrees from the inner channel;

first and second dividing walls separating each outer channel from the inner channel such that the outer channels converge towards the inner channel in the flow direction;

at least three flow distributors each having an outlet fluidly coupled to one of the inlets of the channels, the flow distributors extending substantially over the width of the paper machine and being adapted to feed suspension streams along a flow direction through the channels and the channel outlets, the suspension streams each being emitted from the channel outlets in the form of a wide partial stream, the wide partial streams being combinable with each other, each of the substantially straight courses beginning at the respective distributor; and first and second outer walls each bordering one of the outer channels opposite the dividing walls, the dividing walls extending further in the flow direction than the outer walls so that first and second partial streams from the outer channels are exposed to atmosphere on an outer side after passing the outer walls, each dividing wall having a substantially equal length that terminates in the flow direction with an end surface, the end surfaces extending along a plane perpendicular to the center line of the inner channel, the dividing walls each having an outer surface with an angled portion and a parallel portion, the parallel portion beginning at a point in the flow direction where the outer walls terminate to effect a directional change onto the partial streams from the outer channels, the angled portions of each dividing wall being sized such that the partial streams contact one another at an angle no greater than 10 degrees from each other.

2. The headbox of claim 1 wherein the dividing walls terminate in the flow direction at least 5 mm past the point where the outer walls terminate.

3. The headbox of claim 2 wherein the dividing walls terminate in the flow direction between 10 to 60 mm past the point where the outer walls terminate.

4. The headbox of claim 1 further including flexible lamellae mounted to outer ends of the dividing walls.

5. The headbox of claim 4 wherein the outer ends of the dividing walls are at least 10 mm past the point where the outer walls terminate.

6. The headbox of claim 1 wherein the angle between the inner channel and each outer channel is between 10 and 20 degrees.

7. The headbox of claim 1 wherein the partial streams contact each other at an between 1 to 5 degrees relative to each other.

8. The headbox of claim 1 further including guiding surfaces contiguous with the dividing walls at the point where the outer walls terminate, the guiding surfaces converging towards each other at an angle between 1 and 5 degrees.

9. The headbox of claim 1 wherein the outer walls are substantially rigid and the parallel portion of the dividing walls is flexible.

10. The headbox of claim 1 where the dividing walls are deformable so that each channel has a substantially equal pressure during operation of the headbox.

11. The headbox of claim 1 wherein the channel outlets have widths, and further including screens operably coupled to each outer wall at the point where the outer walls terminate, each screen being adapted to adjust the width of one of the channel outlets.

12. The headbox of claim 1 wherein the channel outlets have widths and wherein the dividing walls are displaceable in the flow direction to vary the widths of the outlets.

13. The headbox of claim 1 and further including at least two different sources of suspension coupled to the channels.

14. A headbox for a paper machine comprising:

at least one inner channel and at least two outer channels each having an outlet, an inlet and a center line with a substantially straight course that changes by no greater than 5 degrees from the inlet to the outlets the outer channels each being oriented at an angle between 8 and 45 degrees from the inner channel;

at least three flow distributors each having an outlet fluidly coupled to one of the inlets of the channels, the flow distributors being adapted to pump fluid streams along a flow direction through the channels, each of the substantially straight courses beginning at their respective distributor;

at least two dividing walls separating the channels such that the channels converge towards each other in the flow direction; and first and second outer walls each bordering one of the channels opposite the dividing walls, the dividing walls and outer walls being configured such that the fluid streams flowing through the inner and outer channels contact each other at the channel outlets at an angle no greater than 10 degrees from each other, the dividing walls extending further in the flow direction than the outer walls so that the fluid in the outer channels exposed on the outer side before passing the dividing walls.

* * * * *